United States Patent [19]

Wilck

[11] Patent Number: 4,821,439

[45] Date of Patent: Apr. 18, 1989

[54] COMPOSITE LABEL

[75] Inventor: Karl H. Wilck, Hamburg, Fed. Rep. of Germany

[73] Assignee: Chalcographi Druck U. Papierverarbeitung Reingold & Wilck KG (GmbH), Hamburg, Fed. Rep. of Germany

[21] Appl. No.: 117,678

[22] Filed: Nov. 5, 1987

[30] Foreign Application Priority Data

Nov. 7, 1986 [DE] Fed. Rep. of Germany ... 8629843[U]

[51] Int. Cl.[4] ..... G09F 3/10

[52] U.S. Cl. ..... 40/638; 40/299; 40/595

[58] Field of Search ..... 40/299, 638, 642, 595; 283/72, 81

[56] References Cited

U.S. PATENT DOCUMENTS

| | | | |
|---|---|---|---|
| 2,213,666 | 9/1940 | Burke | 283/81 |
| 3,230,649 | 1/1966 | Karn | 40/638 |
| 3,297,507 | 1/1967 | Twomey | 40/638 |
| 3,315,386 | 4/1967 | Kest et al. | 40/638 |
| 3,920,122 | 11/1975 | Koehlinger et al. | 40/299 |
| 4,572,855 | 2/1986 | Kalus | 40/638 |

*Primary Examiner*—Gene Mancene
*Assistant Examiner*—Wenceslao J. Contreras
*Attorney, Agent, or Firm*—Harness, Dickey & Pierce

[57] ABSTRACT

A composite label comprising a base sheet or layer having a contact adjesive at its rear surface enabling the separation of the base sheet from a storing or stock means and the sticking to a useful carrier means and a cover sheet adapted to be completely or partially connected to the base sheet by a separable attachment means and fixedly connected to the base sheet along a connecting portion, the cover sheet or portions thereof being adapted to be flapped off from the base sheet after the separation of the separable attachment means, the stock carrier means preferably being of smooth paper allowing an easy removal of the base sheet, whereby the base sheet includes a number of removable or separable labels which are provided with a contact adhesive at their rear surface.

10 Claims, 2 Drawing Sheets

Fig. 1
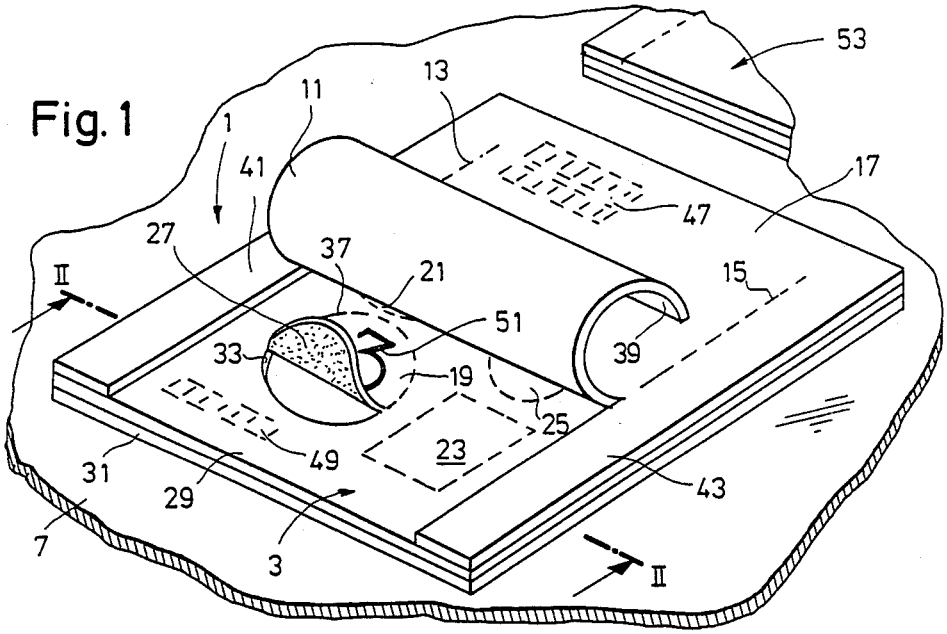
Fig. 2
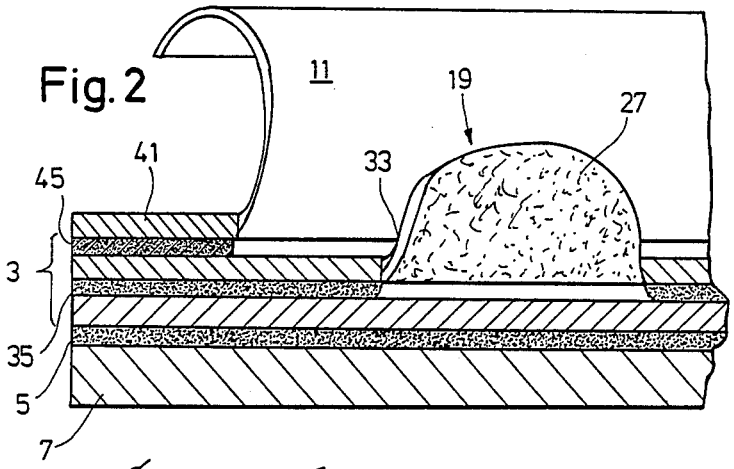
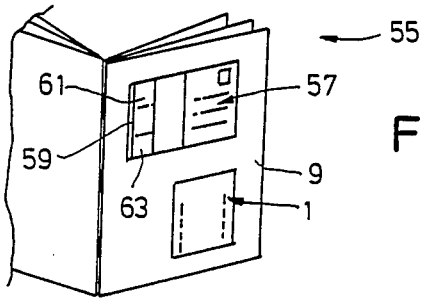
Fig. 3

COMPOSITE LABEL

The invention refers to a composite label comprising a base sheet having a contact adhesive at the rear surface thereof enabling the separation of the base sheet from a stock or support means and the sticking to a useful carrier means, and a cover sheet adapted to be completely or partially connected to the base sheet by a separable attachment means and to be fixedly connected to the base sheet along a connecting portion, the cover sheet or portions thereof being adapted to be flapped off from the base sheet after the separation of the separable attachment means, the stock carrier means preferably being of smooth paper allowing an easy removal of the base sheet.

The designation "contact adhesive" should define a means easily enabling a removal from a predetermined smooth substratum, e.g. silicon paper, for instance by scaling off without loosing the adhering effect through this removal. Suitable contact adhesive materials are available.

Composite labels of the kind mentioned combine a plurality of advantages: A plurality of composite labels can be kept in stock on a foil-like or sheet like stock carrier and can be conveniently removed in case of need and adhered to the used useful carrier means, e.g. on a page of a magazine. A plurality of information carriers, e.g. printed sheets or pages can be provided beneath the cover sheet protected thereby, the information carrier means being accessible after the removal of the cover sheet. The removal of the cover sheet is an interesting operation for the user since it is of a high attention value.

With a known composite label of the mentioned kind a number of sheet-like information carriers adapted to be turned up or opened like a writing block is arranged on the base sheet, the uppermost defining the cover sheet, and the separable attachment being defined by a contact adhesive connection between a projecting marginal portion of the cover sheet and the base sheet.

Thus, the known composite label is provided and suited substantially for reading the information on the sheet or a page-like information carrier.

It may be of interest to conveniently transfer information carriers of the composite label to another location. This can be achieved with the known composite label only in that the respective sheet- or page-like information carrier or a portion thereof is torn off and moved to the desired location and attached thereat. For this, particular requirements are necessary for the attachment. This is inconvenient. Further, the tearing off and the attaching of pages or sheets do not represent a considerable interesting operation for the user.

Object of the invention is to provide a composite label which allows the user in a convenient and interesting manner to transfer portions of the information carrier contained therein.

This problem is solved by the invention providing a composite label of the kind outlined above, characterized in that the base sheet includes a number of removable labels which are provided with a contact adhesive at their rear surface.

In the composite lace according to the invention a label can be peeled off from the base sheet and easily sticked to a desired useful carrier means, particular operational steps being not necessary for the attaching thereof.

Preferably, the base sheet includes a plurality of removable or separable labels so that the using possibilities are enlarged accordingly.

An embodiment of the invention is particularly advantageous wherein the base sheet includes an upper sheet and a lower sheet the upper sheet having cut-out portions wherein the labels are located and releasably sticked to the lower sheet, and wherein the upper sheet and the lower sheet are connected to each other in the portions outside the cutout portions. A plurality of labels can be located adjacent each other and conveniently removed so that the selection of the desired labels and the handling thereof is facilitated.

In the embodiment explained above the cover sheet can lay open the base sheet in that a single relatively large portion is peeled off in order to allow access to the individual labels. In an alternative embodiment of the invention the cover sheet can be divided into a plurality of individual cover sheet portions. These cover sheet portions overlap the labels therebelow. The cover sheet portions are connected to the cover sheet or the base sheet, respectively, through associated connecting portions, exposing, however, the label lying thereunder by turning up the respective cover sheet portion so that the label can be removed from the base sheet in the manner explained above. The remaining cover sheet can be fixedly connected to the base sheet.

The composite label according to the invention cannot only be manufactured as spool or roll but also as individual label. To this purpose the storing carrier means is substituted by a covering paper which preferably includes a weakening line, e g. a scored line adjacent a marginal portion in order to obtain an easy removal of the covering paper.

Embodiments of the invention will be explained hereinafter in connection with drawings.

FIG. 1 is a schematic perspective view of a composite label according to the invention on a storage or stock carrier.

FIG. 2 is a schematic cross section of the illustration in FIG. 1 along line II—II with the adhesive layers being shown exaggeratedly thick.

FIG. 3 shows in a schematic perspective view a label on a useful carrier.

Figure 4:
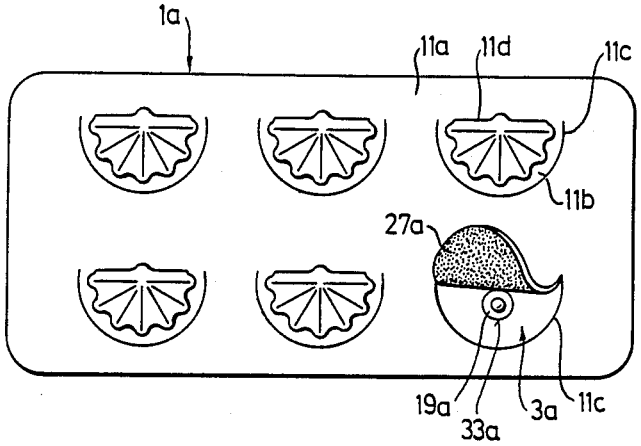
FIG. 4 shows the plan view of a second embodiment of the composite label according to the invention.

In the Figures the individual parts of the composite label for the sake of clarity are illustrated with exaggerated thickness.

The FIGS. 1 to 3 show a composite label 1 including a base sheet 3 or layer of paper provided with a contact adhesive 5 (FIG. 2) on its rear surface. The base sheet or layer 3 is removably adhered to a stock carrier 7. The stock carrier 7 consists of smooth paper in the embodiment illustrated from which the contact adhesive 5 can be easily removed so that the base sheet 3 can be easily removed from the stock carrier 7 and transferred to a useful carrier 9 (FIG. 3) and sticked thereto.

A cover sheet 11 is attached to the base sheet 3 through a releasable or detachable connection 13, 15 so that the cover sheet 11 can be easily removed. In the embodiment shown the cover sheet is fixedly attached to the base sheet 3 through a marginal connection portion 17, e.g. by an adhesive so that the cover sheet can be opened or turned up about the marginal portion 17 after the severing of the attachment 13, 15. The FIGS.

1 and 2 show the cover sheet 11 with the partially severed attachment 13, 15.

In the embodiment illustrated the base sheet 3 includes a plurality of separable labels 19, 21, 23, 25, only label 19 being described in detail in the following. The labels are provided with a contact adhesive 27 at the rear surface thereof. The label 19 is shown in a partially separated state.

In the embodiment illustrated the base sheet 3 includes an upper sheet 29 and a lower sheet 31 which e.g. can consist of paper. The upper sheet 29 includes cut-out portions wherein the labels are located and adhered to the lower sheet by means of the contact adhesive 27. As shown, label 19 is located in the cut-out portion 33. In the zones beyond the cut-out portions lower sheet and upper sheet are connected to each other by gluing 35 or sticking (FIG. 2).

The advantage of the embodiment has to be regarded in the fact that a plurality of labels can be adjacently arranged in the base sheet 3 so that a relatively flat, distinct and simply handy arrangement is achieved.

Appropriately the lower sheet 31 has a smooth surface, e.g. 33, at least in the cut-out portions so that the labels, e.g. 19, can be easily separated.

In the embodiment illustrated the upper sheet 20 is glued or adhered to the lower sheet 31 beyond the cut-out portions, for instance 33 with the same contact adhesive as in case of the labels, for instance 19. This simplifies the manufacturing.

A further simplification of the manufacturing can be achieved with the illustrated embodiment in that the labels, e.g. 19, are defined as portions of the upper sheet 19 which are integrally connected to the upper sheet 29 along weakening lines, e.g. by the perforated weakening line 37 of label 19. In the manufacturing process for instance a single punching or stamping step is necessary to make the labels.

In the illustrated embodiment the cover sheet 11 is not attached at a marginal gripping portion 39 which defines a gripping flap. This facilitates the separation of the cover sheet 11. In the embodiment described the attachments 13, 15 are defined by weakening lines, e.g. perforating lines starting at the ends of the marginal gripping portion 39. The cover sheet 11 is tearably connected with two frame portions 41, 43 along these weakening lines. These frame portions 41, 43 are fixedly attached to the base sheet 3, that is through adhesive 45 (FIG. 2) in the illustrated embodiment. In the described structure the cover sheet 11 with its marginal portions 17, 39 and the frame portions 41, 43 can consist of a single piece of foil or paper. This simplifies the manufacturing and enables a relative small thickness of the composite label.

Further the cover sheet 11 can be easily gripped and separated.

FIGS. 1 and 2 show a state wherein the cover sheet 11 is partially separated.

The base sheet 3 and the cover sheet 11 can be provided with information, e.g. writings 47 or 49, respectively, and also the labels, e.g. 19, bear information, e.g. 51.

As shown in FIG. 1 further composite labels, e.g. 53 can be provided on the stock carrier 7 so that an easily handy stock is provided.

FIG. 3 explains a possible use of the described composite label. A page of a magazine 55 serves as useful carrier 9; the composite label 1 is adhered to the page. An ordering postcard 57 is separately adhered to a margin 19 of the magazine page and includes rubrics 61, 63 for the adhering of the labels which for instance designate the desired colour of an ordered product and can be taken from the composite label 1 .

FIG. 4 shows an individual composite label **1*a* which includes a base sheet 3*a* which can be structured similar to base sheet 3 according to the Figures explained above. A cover sheet 11*a* is adhered to base sheet 3*a*. The cover sheet 11*a* includes a plurality of cover sheet portions 11*b* which are adapted to be partially separated from the cover sheet 11*a* by means of a cutting or scoring line 11*c* as shown at the right of the bottom in FIG. 4. The cover sheet portions 11*b* are attached to the base sheet 3*a* through a separable adhesive 27*a*. The scoring line 11*c* is circularly shaped and extends slightly beyond an angle of 180°. The remaining marginal portion 11*d* defines a fixed connection between the cover sheet portion 11*b* and the cover sheet 11*a***.

As can be seen a shell is illustrated on the cover sheet portions **11*b*. Labels 19*a* are located in a cut-out portion 33*a* of the base sheet 3*a* in a manner explained above. The cut-out portion 33*a* can be defined by a sharply punched perforation. In the shown embodiment a pearl is illustrated on label 19*a***.

Figure 5:
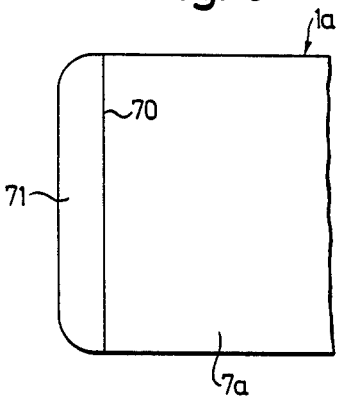
FIG. 5 shows a portion of the rear surface of the label according to FIG. 4.

FIG. 5 shows the rear surface of the individual composite label **1*a* including a stock carrier 7*a* or a covering paper. The covering paper 7*a* must be removed in order to stick or adhere the composite label 1*a* to a useful carrier. For this purpose a scoring line 70 is formed at the left margin (FIG. 5) parallel to the left edge. After the separation of the covering paper 7*a* a gripping portion 71 remains for the handling of the composite label 1*a***.

I claim:

1. A composite label comprising a base layer having a contact adhesive at its rear surface enabling the separation of the base layer from a storing means and the adhesion to a useful carrier means and a cover sheet adapted to be connected to the base sheet by a separable attachment means and fixedly connected to the base sheet along a connecting portion, the cover sheet being adapted to be removed from the base sheet after the separation of the separable attachment means, the stock carrier means allowing an easy removal of the base sheet, characterized in that the base sheet includes a number of removable labels provided with a contact adhesive at their rear surface.

2. The composite label according to claim 1, characterized in that the base sheet includes a plurality of separable labels.

3. The composite label according to claim 1, characterized in that the base sheet includes an upper sheet and a lower sheet, the upper sheet having cut-out portions wherein the labels are located and adhered to the lower sheet, and in that beyond the cut-out portions the upper sheet and the lower sheet are connected to each other.

4. The composite label according to claim 3, characterized in that the lower sheet has a smooth surface at least in the range of the cut-out portions of the upper sheet to allow an easy separation of the labels.

5. The composite label according to claim 3, characterized in that the upper sheet is adhered to the lower sheet in the portions beyond the cut-out portion of the upper sheet with the same contact adhesive as the labels.

6. The composite label according to claim 3 characterized in that the labels are portions of the upper sheet integrally connected to the upper sheet along weakening lines.

7. The composite label according to claim 1, characterized in that the cover sheet is not attached at a marginal gripping portion to form a gripping flap, and in that the cover sheet can be removed from frame portions fixedly attached to the base sheet through weakening lines starting at the ends of the marginal gripping portion.

8. The composite label according to claim 7, characterized in that the cover sheet and the frame portions consist of one piece.

9. The composite label according to claim 1, characterized in that only cover sheet portions overlapping the labels are fixedly attached to one of the sheets along connection portions, the remainder of the sheet portions being separably attached while the remaining sheet is secured to the other sheet.

10. The composite label according to claim 1, characterized in that the stock carrier is formed as individual covering paper and includes a weakening line at a marginal portion for an easy separation of the base sheet from the covering paper.

* * * * *